US009055858B2

(12) United States Patent
Jerg et al.

(10) Patent No.: US 9,055,858 B2
(45) Date of Patent: Jun. 16, 2015

(54) METHOD FOR OPERATING A WATER-CARRYING HOUSEHOLD APPLIANCE

(75) Inventors: Helmut Jerg, Giengen (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 218 days.

(21) Appl. No.: 13/054,088

(22) PCT Filed: Jul. 24, 2009

(86) PCT No.: PCT/EP2009/059588

§ 371 (c)(1),
(2), (4) Date: Jan. 14, 2011

(87) PCT Pub. No.: WO2010/012662

PCT Pub. Date: Feb. 4, 2010

(65) Prior Publication Data

US 2011/0114134 A1 May 19, 2011

(30) Foreign Application Priority Data

Jul. 28, 2008 (DE) ..... 10 2008 040 770

(51) Int. Cl.

| | |
|---|---|
| ***A47L 15/42*** | (2006.01) |
| ***A47L 15/48*** | (2006.01) |
| ***D06F 58/26*** | (2006.01) |

(52) U.S. Cl.

CPC ..... *A47L 15/481* (2013.01); *D06F 58/26* (2013.01)

(58) Field of Classification Search

CPC .... A47L 15/481; A47L 15/0042; D06F 58/26

USPC ..... 134/25.2, 25.1, 18

See application file for complete search history.

(56) References Cited

U.S. PATENT DOCUMENTS

| | | | | |
|---|---|---|---|---|
| 4,908,148 | A * | 3/1990 | Caravajal et al. | 510/514 |
| 6,138,692 | A * | 10/2000 | Kobos et al. | 134/25.2 |
| 2006/0278257 | A1* | 12/2006 | Jerg et al. | 134/56 D |
| 2007/0101609 | A1* | 5/2007 | Jerg et al. | 34/416 |
| 2008/0083433 | A1* | 4/2008 | Jerg et al. | 134/18 |

(Continued)

FOREIGN PATENT DOCUMENTS

| | | | |
|---|---|---|---|
| DE | 1628632 | A1 | 8/1970 |
| DE | 2016831 | A1 | 10/1971 |

(Continued)

OTHER PUBLICATIONS

Machine translation of DE 2232119A1.*

(Continued)

*Primary Examiner* — Michael Kornakov
*Assistant Examiner* — Douglas Lee
(74) *Attorney, Agent, or Firm* — James E. Howard; Andre Pallapies

(57) ABSTRACT

A method for operating a water-conducting domestic appliance is provided. During at least one of a plurality of successive partial program steps, a first medium is heated at least at times by means of a first heating element and items undergoing treatment are heated by applying the heated first medium to the items. When the first heating element is inactive, a second medium is heated at least at times by means of a second heating element and the items undergoing the treatment are heated by the heated second medium.

24 Claims, 4 Drawing Sheets

(56) References Cited

U.S. PATENT DOCUMENTS

| | | | |
|---|---|---|---|
| 2008/0127997 | A1 | 6/2008 | Jerg et al. |
| 2009/0139544 | A1 | 6/2009 | Ahn et al. |

FOREIGN PATENT DOCUMENTS

| | | | | |
|---|---|---|---|---|
| DE | 2232119 | A1 | * | 1/1974 |
| DE | 2848375 | A1 | | 5/1980 |
| DE | 3626887 | A1 | | 2/1988 |
| DE | 4243868 | A1 | | 7/1994 |
| DE | 10353774 | A1 | | 2/2005 |
| DE | 10353775 | A1 | | 2/2005 |
| JP | 07000338 | | | 1/1995 |
| JP | 08019505 | | | 1/1996 |
| WO | WO 2006129963 | A2 | * | 12/2006 |

OTHER PUBLICATIONS

Report of Examination and National Search Report CN 200980130010.4.

Decision on Granting a Patent RU 2011105099 dated Nov. 28, 2013.

* cited by examiner

METHOD FOR OPERATING A WATER-CARRYING HOUSEHOLD APPLIANCE

BACKGROUND OF THE INVENTION

The invention relates to a method for operating a water-conducting domestic appliance.

Known from DE 10 2005 004 089 A1 is a method for operating a water-conducting domestic appliance, which is to say a dishwasher. A sorption device having a reversibly dehydratable material is provided as the drying system which during a drying step removes and stores a volume of water from the air requiring to be dried. Taking place at an ensuing cleaning step is a regeneration process or, as the case may be, desorption during which an air current flowing through the drying means is heated by means of an air heater. The volume of water stored in the drying means is released as hot water vapor with the heated air current and returned to the washing container and the items requiring to be washed are heated. That kind of heating is, though, time-consuming.

BRIEF SUMMARY OF THE INVENTION

The object of the invention is hence to provide a method for operating a water-conducting domestic appliance, which method allows the time required to be reduced.

The invention proceeds from a method for operating a water-conducting domestic appliance, in particular a dishwasher or tumble dryer, which method includes a plurality of successive partial program steps during at least one of which a first medium is heated at least at times by means of a first heating element and items undergoing treatment are heated by being subjected to the heated first medium.

It is inventively provided for a second medium to be heated at least at times by means of a second heating element when the first heating element is inactive and for the items undergoing treatment to be heated by means of the heated second medium. A greater performance capability of the second heating element therein allows the heating process to be accelerated. It is furthermore ensured thereby that the power consumption will remain below a maximum power consumption of the water-conducting domestic appliance. The maximum power consumption is limited by the maximum power capacity of the domestic power supply serving to supply the water-conducting domestic appliance with electric energy. A level of power consumption by the water-conducting domestic appliance that exceeds the domestic power supply's maximum power capacity will cause the domestic power supply to be overloaded with the result that protective elements such as, for example, fusible cutouts or automatic circuit breakers will be triggered and a further supply of energy prevented. Uninterrupted operation of the water-conducting domestic appliance will thus be ensured.

It is further preferably provided for the first medium to be a gaseous medium and the second medium a liquid medium. The liquid medium's greater heat capacity therein reduces the length of heating time. The gaseous medium can be heated by means of an electric air heater, for example supported by a ventilating fan for circulating the gaseous medium. The liquid medium can be heated by means of a continuous-flow heater, for example supported by a circulating pump for circulating the liquid medium.

In a first, preferred embodiment variant it is provided for a first medium to be heated during the partial program step at least at times by means only of the first heating element and for a second medium to be heated at least at times by means only of the second heating element.

In a further, preferred embodiment variant it is provided for a first medium to be heated during a first partial program step at least at times by means only of the first heating element and for a second medium to be heated during a second partial program step at least at times by means only of the second heating element.

The two heating elements are therefore operated only in an alternating manner either during a single partial program step or during at least two partial program steps. It will be ensured thereby that overheating cannot occur inside the water-conducting domestic appliance on account of at least at times simultaneous operation of the two heating elements resulting in, for example, damage to one of the two heating elements and/or to a sorption device having a reversibly dehydratable material, for example zeolite.

Preferably it is provided for items undergoing treatment to be subjected during an ensuing partial program step to a second medium. Said step can therein be a pre-washing step during which in the case of, for example, a dishwasher coarse soiling of the items undergoing treatment or, as the case may be, being washed is removed, or it can be a cleaning step during which a cleansing agent is added for removing stubborn dirt.

It is further preferably provided for a medium, for example washing water, to be replaced at least once between two partial program steps. A mixed temperature develops that is between the temperature of the liquid medium and that of the items undergoing treatment after the first partial program step. The difference in temperature to be overcome between the mixed temperature and the maximum temperature requiring to be attained during the cleaning step will be correspondingly less so that correspondingly less energy will have to be expended.

It is furthermore preferably provided for a cleansing agent to be added during a partial program step embodied as a cleaning step for cleaning items undergoing treatment.

It is also preferably provided for a partial program step embodied as a pre-washing step for cleaning items undergoing treatment without the addition of a cleansing agent to be performed before the cleaning step so that the pre-washing step will be performed directly before the cleaning step at which higher temperatures are attained than during the pre-washing step.

It is therein preferably provided for a post-washing phase to take place during the cleaning step, during which phase items undergoing treatment are warmed by being subjected to a second medium heated by means of the second heating element.

In a further embodiment variant it is preferably provided for a partial program step to be embodied as a final rinsing step with heating of washing water during which surfactants are added.

It is further provided for a partial program step embodied as an intermediate rinsing step for cleaning items undergoing treatment without the addition of a cleansing agent to be performed before the final rinsing step so that the intermediate rinsing step will be performed directly before the final rinsing step at which higher temperatures are attained than during the intermediate rinsing step.

It is furthermore preferably provided for a drying step to be performed as the final partial program step during which the second medium is absorbed by a reversibly dehydratable material. Liquid stored again in the reversibly dehydratable material will hence be available for a renewed treatment cycle.

It is therein preferably provided for the reversibly dehydratable material to be at least partially desorbed during a partial program step so that the reversibly dehydratable material will then be absorbent again.

BRIEF DESCRIPTION OF THE DRAWINGS

Two exemplary embodiments of the invention are described below with the aid of the attached figures.

DETAILED DESCRIPTION OF EXEMPLARY EMBODIMENTS OF THE PRESENT INVENTION

Figure 1:
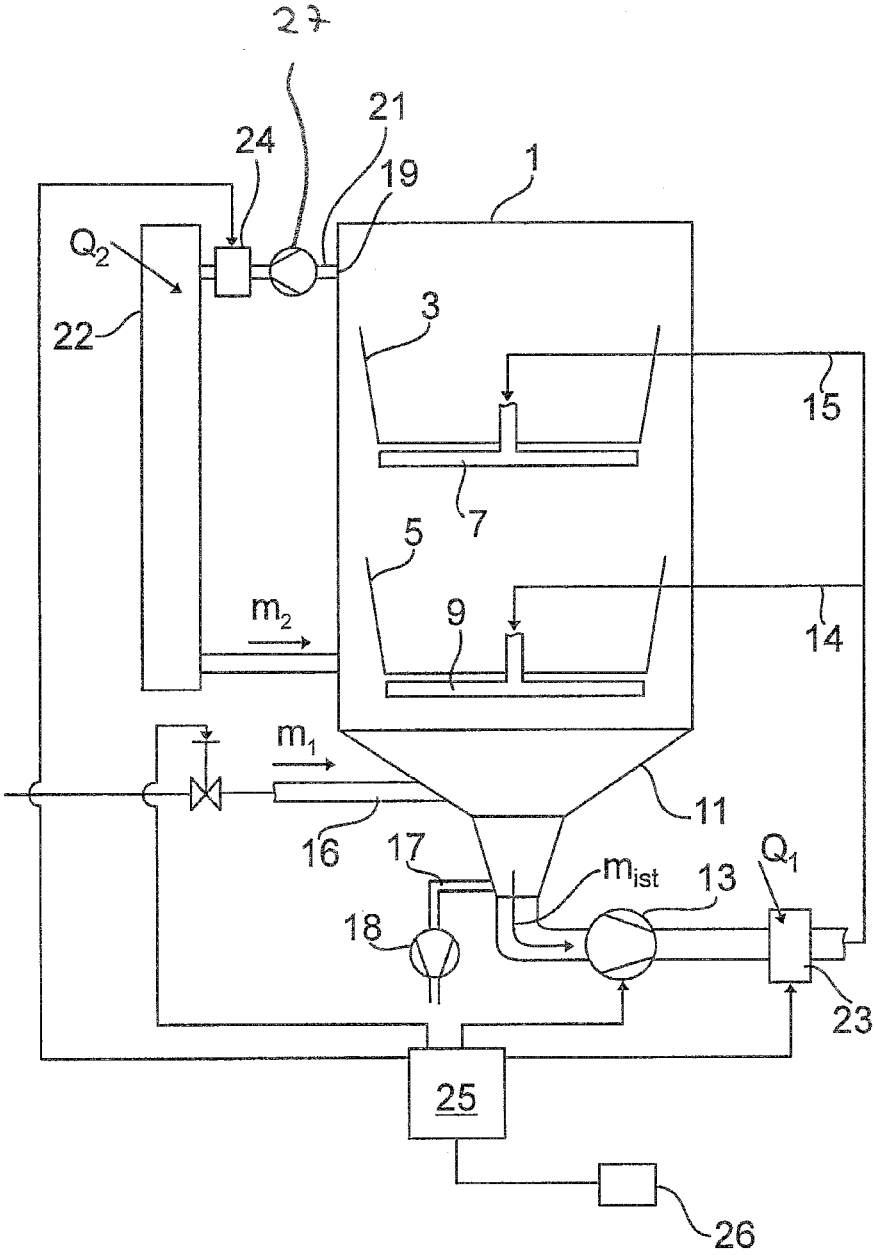
FIG. 1 is a schematic block diagram of a dishwasher for executing a washing method according to the first exemplary embodiment.

Shown in FIG. 1 as an exemplary embodiment of a water-conducting domestic appliance is a dishwasher having a washing container 1 in which items requiring to be washed (not shown) can be arranged in crockery baskets 3, 5. Arranged in washing container 1 shown here as examples of spraying devices are two spray arms 7, 9 that are provided in different spraying planes and via which the items requiring to be washed are subjected to washing liquid. Provided in the washing-container base is a pump body 11 having a circulating pump 13 that is fluidically connected via feed pipes 14, 15 to spray arms 7, 9. Pump body 11 is joined also via connecting branches to a fresh-water feed pipe 16 coupled to the water-supply network as well as to a drainage pipe 17 in which a drain pump 18 for pumping the washing liquid out of the washing container is located.

Washing container 1 has in its upper region an outlet opening 19 connected via a pipe 21 to a drying device embodied as a sorption device 22. An air blower 27 and a heating element 24 are connected in pipe 21 to sorption device 22. Sorption device 22 contains as the drying means a reversibly dehydratable material such as, for instance, zeolite by means of which air is dried at a drying step T. A heavily moisture-laden air current is for that purpose ducted by means of air blower 27 from washing container 1 through sorption device 22. The zeolite provided in sorption device 22 absorbs the moisture in the air and the relatively dry air is returned to washing container 1.

Volume of water $m_2$ stored in the zeolite at drying step T can be released again during a regeneration process, which is to say during a desorption process, by heating the drying means of sorption device 22. An air current heated to very high temperatures by heating element 24 is for that purpose ducted through sorption device 22 by means of fan 27, released as hot water vapor with the water stored in the zeolite, and thus returned to washing container 1.

Figure 2:
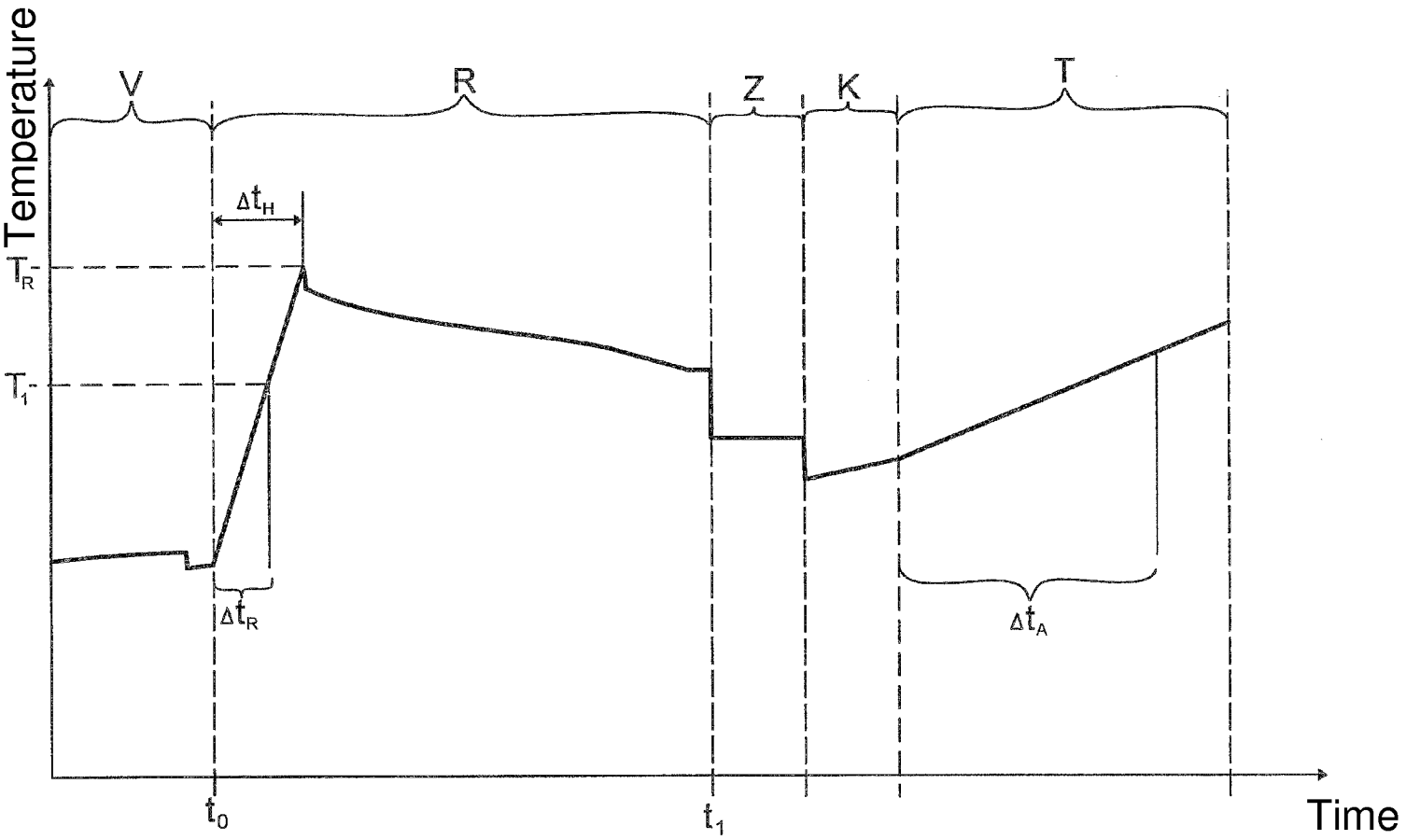
FIG. 2 is a temperature-time chart for illustrating a washing-program sequence in a first energy-saving washing operating mode.

FIG. 2 shows a time-based program sequence having the individual partial program steps comprising a washing operation namely pre-washing V, cleaning R, intermediate rinsing Z, final rinsing K, and drying T.

The above-described regeneration process in sorption device 22 takes place in the temperature-time profile shown in FIG. 2 during time interval $\Delta t_R$. The partial program steps indicated in FIG. 2 are controlled by means of a control device 25 by appropriately driving circulating pump 13, drain pump 18, air blower 23, drying device 22, and other control components.

Figure 3:
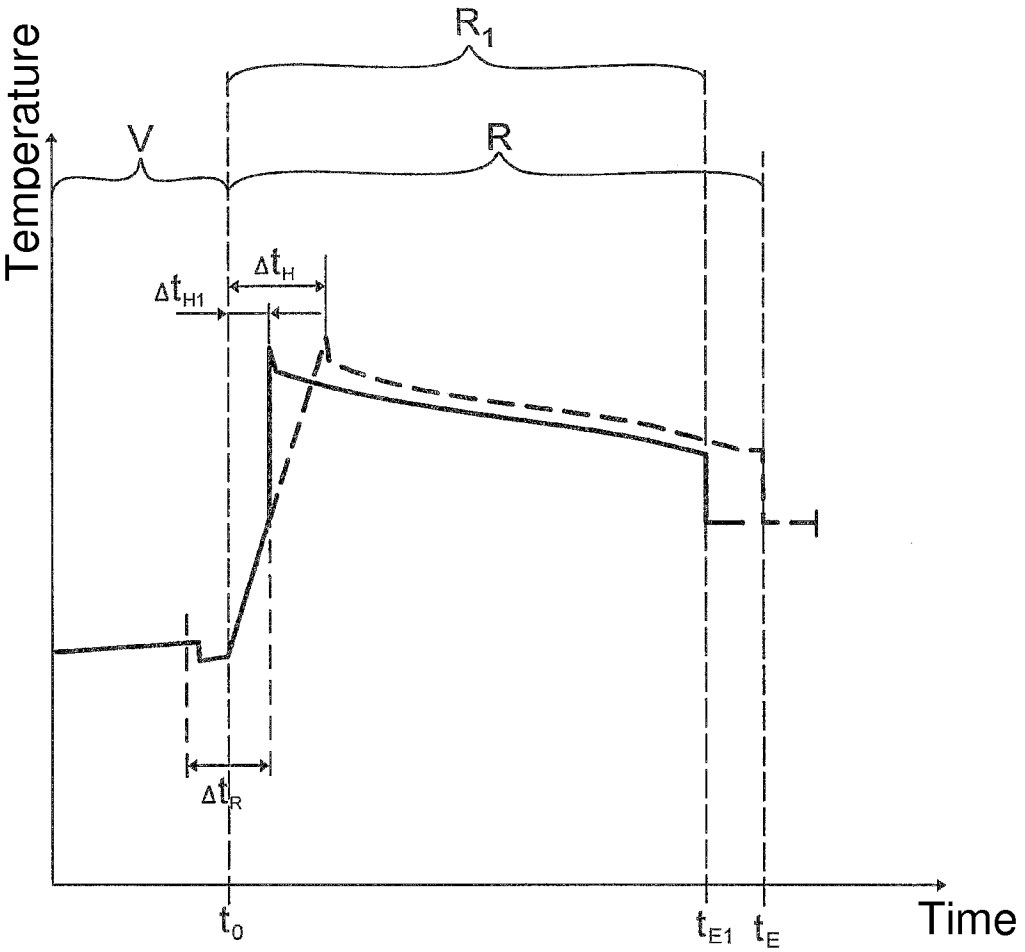
FIG. 3 is a time chart representing only the cleaning step for illustrating a washing method in the second, time-saving washing operating mode according to the first exemplary embodiment.

Regeneration process $\Delta t_R$ starts according to FIGS. 2 and 3 at the beginning of cleaning step R at instant $t_0$. Volume of water $m_2$ stored in the drying means is returned as water vapor to washing container 1 during regeneration process $\Delta t_R$. Said volume of water $m_2$ was removed from the moisture-laden air current requiring to be dried at drying step T of the preceding washing operation during an adsorption process $\Delta t_A$. The volume of washing liquid $m_{ist}$ made available overall at cleaning step R is hence the totality of a volume of fresh water m added via fresh-water pipe 16 and volume of water $m_2$ returned during regeneration process $\Delta t_R$.

During heating phase $\Delta t_H$ taking place at the beginning of cleaning step R, heating initially takes place during regeneration process $\Delta t_R$ by means of second heating element 24, which is to say the air heater by means of which a heating capacity $Q_2$ is introduced into washing container 1. A heating capacity $Q_1$ is then introduced into washing container 1 by means of first heating element 23, which is to say the water heater. Heating capacity $Q_1$ of water heater 23 can be around 2200 W while heating capacity $Q_2$ of air heater 24 is of an order of magnitude of only 1400 W.

As proceeds from FIG. 2, during heating phase $\Delta t_H$ the washing liquid is heated initially by means only of the water vapor that is released during regeneration process $\Delta t_R$ and can heat the washing liquid by means of heating capacity $Q_2$ to a temperature $T_1$ of approximately 40° C. by way of example here. Water heater 23 operating at a far greater heating capacity $Q_1$ is not cut in until after regeneration process $\Delta t_R$ has ended. Thermal damage to the drying means in the sorption device can be avoided by water heater 23 that is not cut in until after regeneration process $\Delta t_R$ has ended. By means of water heater 23 that is cut in it is possible to raise the temperature of the washing liquid further from temperature $T_1$ of 40° C. to cleaning temperature $T_R$ that can be 51° C. by way of example here.

In the first operating mode, shown in FIG. 2, the heat $Q_2$ released during regeneration process $\Delta t_R$ is therefore used in an energy-saving manner for heating washing liquid $m_{ist}$ during heating phase $\Delta t_H$.

As further proceeds from FIG. 1, control device 25 has a signal link to a changeover switch 26 that can be manually operated by a user. Operating changeover switch 26 will enable a user to change over from the first energy-saving washing operating mode described above with the aid of FIG. 2 to a second washing operating mode described below.

In the second washing operating mode the volume of washing liquid is heated at cleaning step R during what compared with the first washing operating mode is a temporally reduced heating phase $\Delta t_H$, as is shown in FIG. 3. FIG. 3 shows heating phase $\Delta t_H$ of both the first washing operating mode (dashed line) and the second washing operating mode (unbroken line). As proceeds from FIG. 3, regeneration process $\Delta t_R$ is brought forward in time in the second washing operating mode. That is to say regeneration process $\Delta t_R$ here already starts during pre-washing step V and temporally overlaps start time $t_0$ of cleaning step R. Bringing regeneration process $\Delta t_R$ forward in time enables water heater 23 that operates at a far greater heating capacity $Q_1$ to begin heating the washing liquid in the washing container sooner with no danger of thermal damage being sustained as a result by the zeolite provided in sorption device 22.

Cleaning temperature $T_R$ will in that way be attained in an accelerated manner in the second washing operating mode, as a result of which cleaning step $R_1$ can analogously also be ended at an earlier instant $t_{E1}$. Water heater 23 can—as an alternative to the exemplary embodiment shown—even be started at start time $t_0$ of cleaning step $R_1$ if the regeneration process is suitably positioned in time terms relative to start time $t_0$ of cleaning step R. That is because at the start of the heating phase water heater 23 initially only heats the washing liquid in washing container 1 and the air only after a time delay. Thus at the start of heating phase $\Delta t_{H1}$ there is no risk of an over-heated air current reaching sorption device 22 during regeneration process $\Delta t_R$ and thermally damaging the zeolite.

Figure 4:
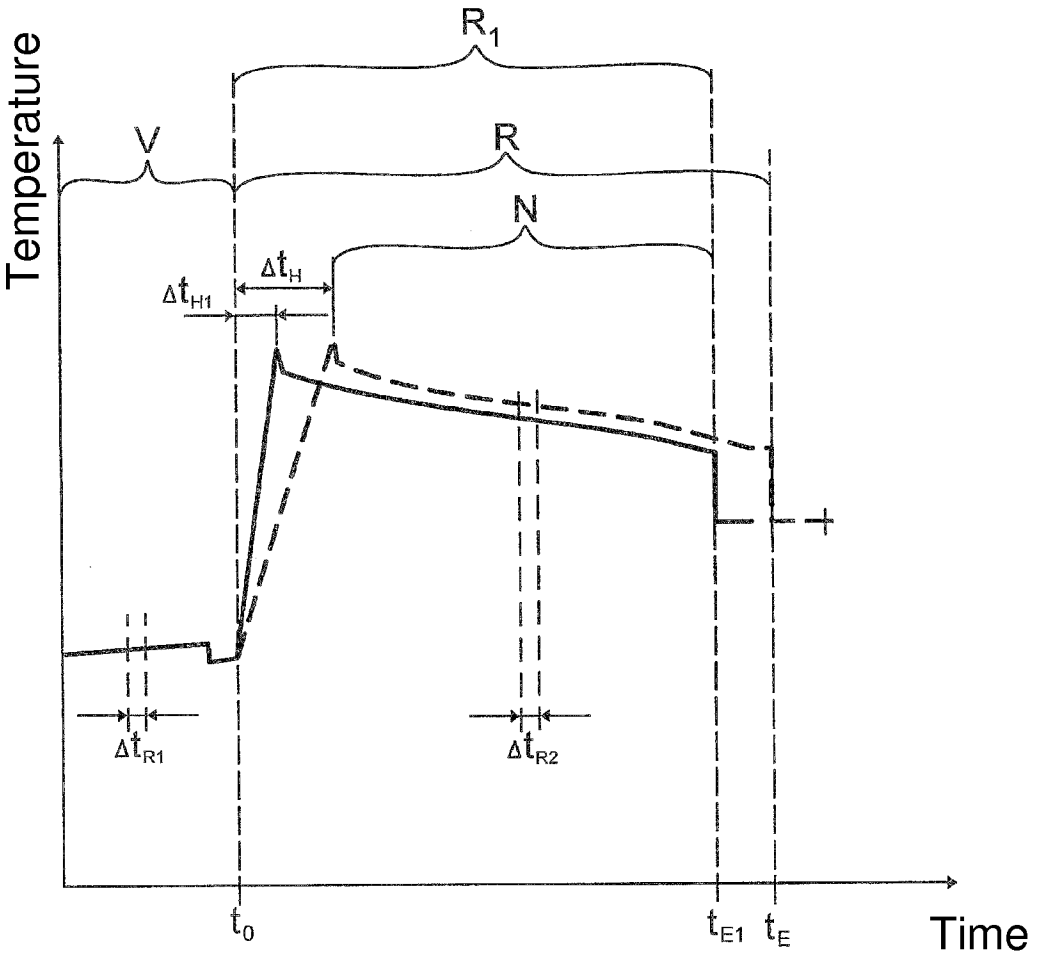
FIG. 4 is a chart corresponding to FIG. 3 according to the second exemplary embodiment.

Described in FIG. 4 is a washing method taking place during the second washing operating mode according to the second exemplary embodiment. Regeneration process $\Delta t_R$ takes place in contrast to FIG. 3 totally outside heating phase $\Delta t_H$. Regeneration process $\Delta t_R$ is furthermore divided into temporally mutually separate regeneration segments $\Delta t_{R1}$, $\Delta t_{R2}$ which by way of example are approximately equally long in FIG. 4. As proceeds from FIG. 4, first regeneration segment $\Delta t_{R1}$ takes place already at pre-washing step V. Second regeneration segment $\Delta t_{R2}$ then starts after heating phase $\Delta t_H$ during post-washing time N.

LIST OF REFERENCES

1 Washing container
3 Crockery basket
5 Crockery basket
7 Spray arm
9 Spray arm
11 Pump body
13 Circulating pump
14 Feed pipe
15 Feed pipe
16 Fresh-water feed pipe
17 Drainage pipe
18 Drain pump
19 Outlet opening
21 Pipe
22 Drying device
23 Heating element
24 Heating element
25 Control device
26 Changeover switch
27 Air blower
29 Temperature sensor
V Pre-washing
R Cleaning
Z Intermediate rinsing
K Final rinsing
T Drying
$T_R$ Cleaning temperature
$\Delta t_A$ Adsorption process
$\Delta t_H$ Heating phase
$\Delta t_R$ Regeneration process
$m_1$ Volume of fresh water added
$m_2$ Volume of water returned
$m_{ist}$ Volume of washing liquid
$Q_1$ Heating capacity
$Q_2$ Heating capacity
$t_0$ Start time of cleaning step R
$t_E$ End time of cleaning step R

The invention claimed is:

1. A method for operating a water-conducting domestic appliance having a sorption device, the method comprising:

during at least one of a plurality of successive partial program steps:

(i) heating a first medium by means of a first heating element with a heating capacity of $Q_2$ during a first partial program step wherein a reversibly dehydratable material in the sorption device is at least partially desorbed, and heating items undergoing treatment by applying the heated first medium to the items; and (ii) following the heating the first medium, when the first heating element is inactive, heating a second medium by means of a second heating element with a heating capacity of $Q_1$ and heating the items undergoing the treatment by the heated second medium;

wherein both of the first heating element and the second heating element are operated asynchronously to prevent overheating of the water-conducting domestic appliance.

2. The method of claim 1, wherein the water-conducting domestic appliance is one of a dishwasher and a tumble dryer.

3. The method of claim 1, wherein the first medium is a gaseous medium and the second medium is a liquid medium.

4. The method of claim 1, wherein the first medium is heated during the first partial program step of the at least one of a plurality of successive partial program steps by means of the first heating element only, and the second medium is heated by means of the second heating element.

5. The method of claim 1, wherein the first medium is heated during the first partial program step by means only of the first heating element and the second medium is heated during a second partial program step by means only of the second heating element.

6. The method of claim 1, wherein, in the at least one of a plurality of successive partial program steps, the second medium is subsequently applied to the items undergoing the treatment.

7. The method of claim 1, wherein at least one of the first medium and the second medium is replaced at least once between two partial program steps.

8. The method of claim 7, wherein the second medium is replaced at least once between the two partial program steps.

9. The method of claim 1, wherein a cleansing agent is added during a cleaning step in order to clean the items undergoing the treatment.

10. The method of claim 9, wherein, before the cleaning step, a pre-washing step for cleaning the items undergoing the treatment is performed without the addition of the cleansing agent.

11. The method of claim 9, wherein, during the cleaning step, a post-washing phase takes place during which the items undergoing the treatment are warmed by applying the second medium that is heated by means of the second heating element to the items.

12. The method of claim 1, wherein, during a final rinsing step, washing water is heated and surfactants are added.

13. The method of claim 12, wherein, before the final rinsing step, an intermediate rinsing step for cleaning the items undergoing the treatment is performed without adding a cleansing agent.

14. The method of claim 1, wherein a drying step is performed as a final partial program step during which the second medium is absorbed by the reversibly dehydratable material.

15. The method of claim 14, wherein the reversibly dehydratable material is at least partially desorbed during the first partial program step.

16. The method of claim 1, further including operating the first and second heating elements in an alternating manner during a single partial program step.

17. The method of claim 16, wherein $Q_2$ is substantially ⅔ of $Q_1$.

18. The method of claim 1, further including operating the first and second heating elements in an alternating manner in a time frame spanning the end of the first partial program step and the beginning of a subsequent, second partial program step.

19. The method of claim 1, wherein $Q_1$ is around 2200 W.

20. The method of claim 1, wherein $Q_2$ is substantially ⅔ of $Q_1$.

21. The method of claim 1, wherein the heating of the first medium with the first heating element is part of a regeneration phase, $\Delta t_R$, for a water and moisture absorbent material.

22. The method of claim 21, wherein $\Delta t_R$ spans an end period of the first partial program step and a beginning period of a second partial program step.

23. The method of claim 21, wherein $Q_1 > Q_2$.

24. The method of claim 23, wherein the second heating element raises the temperature of the second medium to a cleaning temperature $T_R$, with $T_R$ being greater than a temperature $T_1$ of the second medium that is achieved by the first heating element during the regeneration phase, $\Delta t_R$.

* * * * *